US009541353B2

(12) United States Patent
Schweitzer

(10) Patent No.: US 9,541,353 B2
(45) Date of Patent: Jan. 10, 2017

(54) TEMPORARY OFFENSE FOR ULTIMATE CONTROL AGAINST HARM

(71) Applicant: Robert Martin Schweitzer, Columbia, MD (US)

(72) Inventor: Robert Martin Schweitzer, Columbia, MD (US)

( * ) Notice: Subject to any disclaimer, the term of this patent is extended or adjusted under 35 U.S.C. 154(b) by 0 days.

(21) Appl. No.: 14/799,103

(22) Filed: Jul. 14, 2015

(65) Prior Publication Data

US 2015/0369571 A1 Dec. 24, 2015

Related U.S. Application Data

(63) Continuation of application No. 12/929,093, filed on Mar. 24, 2011, now Pat. No. 9,086,256.

(51) Int. Cl.

| | |
|---|---|
| ***H01T 23/00*** | (2006.01) |
| ***F41H 13/00*** | (2006.01) |
| ***A41D 19/00*** | (2006.01) |
| ***A41D 19/015*** | (2006.01) |

(52) U.S. Cl.

CPC ..... *F41H 13/0018* (2013.01); *A41D 19/0024* (2013.01); *A41D 19/015* (2013.01)

(58) Field of Classification Search

CPC ..... H01T 23/00
USPC ..... 361/232
See application file for complete search history.

(56) References Cited

U.S. PATENT DOCUMENTS

| | | | | |
|---|---|---|---|---|
| 4,370,696 | A * | 1/1983 | Darrell | F41B 15/04 231/7 |
| 4,485,426 | A * | 11/1984 | Kerls | A41D 1/00 361/232 |
| 7,477,504 | B1 * | 1/2009 | Delida | F41H 13/0018 361/230 |
| 2004/0154071 | A1 * | 8/2004 | Frahm | F41H 13/0018 2/160 |
| 2004/0244091 | A1 * | 12/2004 | Parren | F16P 3/12 2/161.6 |
| 2004/0264099 | A1 * | 12/2004 | Sikes | H05C 1/06 361/232 |
| 2005/0231471 | A1 * | 10/2005 | Mallard | G06F 3/014 345/156 |
| 2010/0093457 | A1 * | 4/2010 | Ahern | A63B 24/0003 473/202 |
| 2012/0128995 | A1 * | 5/2012 | Leto | C09D 175/04 428/473 |
| 2013/0036653 | A1 * | 2/2013 | Holliman | A22B 3/083 43/17.1 |
| 2013/0152272 | A1 * | 6/2013 | Schultz | G06F 3/044 2/161.6 |

* cited by examiner

*Primary Examiner* — Rexford Barnie
*Assistant Examiner* — Joseph Inge
(74) *Attorney, Agent, or Firm* — Merek, Blackmon & Voorhees, LLC

(57) ABSTRACT

The device is a self-contained-defense-system. The entire unit is housed inside a blended set of athletic gloves and emits an electrical charge against an unwanted attacker. It can be utilized by men or women, both young and old, for personal safety. The electrical charge emitted is not strong enough to kill, but the voltage can be increased in order to assist the military and the police.

17 Claims, 5 Drawing Sheets

TEMPORARY OFFENSE FOR ULTIMATE CONTROL AGAINST HARM

The subject patent application is a continuation of U.S. patent application Ser. No. 12/929,093 filed on Mar. 24, 2011 from which priority is claimed under 35 USC §120. The entire content of U.S. patent application Ser. No. 12/929,093 is incorporated herein by reference.

BACKGROUND

This is something new and unparalleled to assist people, especially women, remain safe in today's crazy world.

The device is a self-contained-defense-system. The entire unit is housed inside a blended set of athletic gloves and emits an electrical charge against an unwanted attacker. It can be utilized by men or women, both young and old, for personal safety. The electrical charge emitted is not strong enough to kill but the voltage can be increased in order to assist the military and the police.

SUMMARY OF THE INVENTION

Too many people have the false hope that they will be safe if they carry a small knife, mace or a stun gun when they go outside to walk or run. Imagine the young professional female out running in the early morning or walking home late at night from work with her iPod plugged into both ears. The woman is basically oblivious to her surroundings and is therefore a prime candidate for an unwanted attack.

The advantage of The T.O.U.C.H. is that the victim is always prepared for that unprovoked assault. Nearly, every day there is a news-piece about some young girl or woman that has been attacked, beaten, raped or killed. In these types of situations, The T.O.U.C.H. is perfect to have at your fingertips because it could make the difference between life or death.

The actually invention, is the controlled shock and repelling application against an attacker. The purpose and advantage of The T.O.U.C.H. is to basically save a human life.

DETAILED DESCRIPTION

Figure 1:
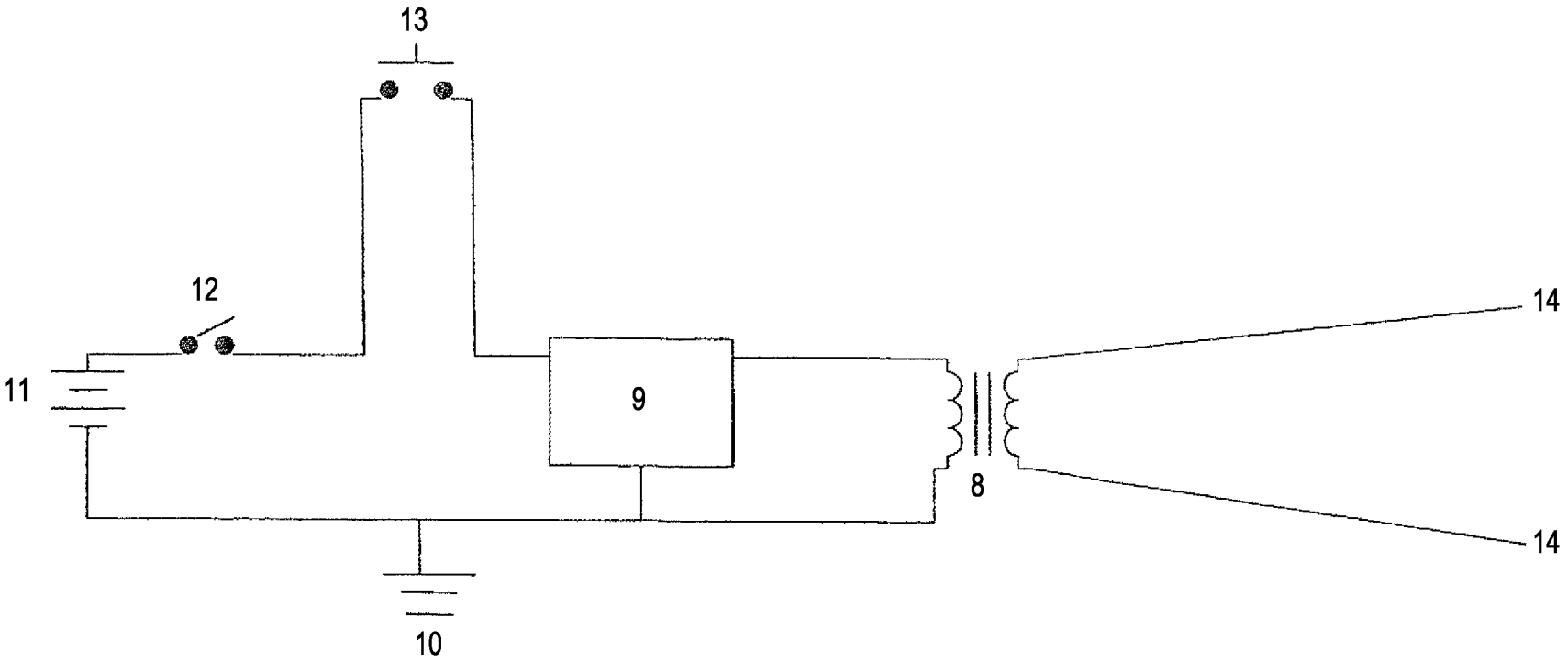

FIG. 1: Shows the schematic of the electronics.

Figure 2:
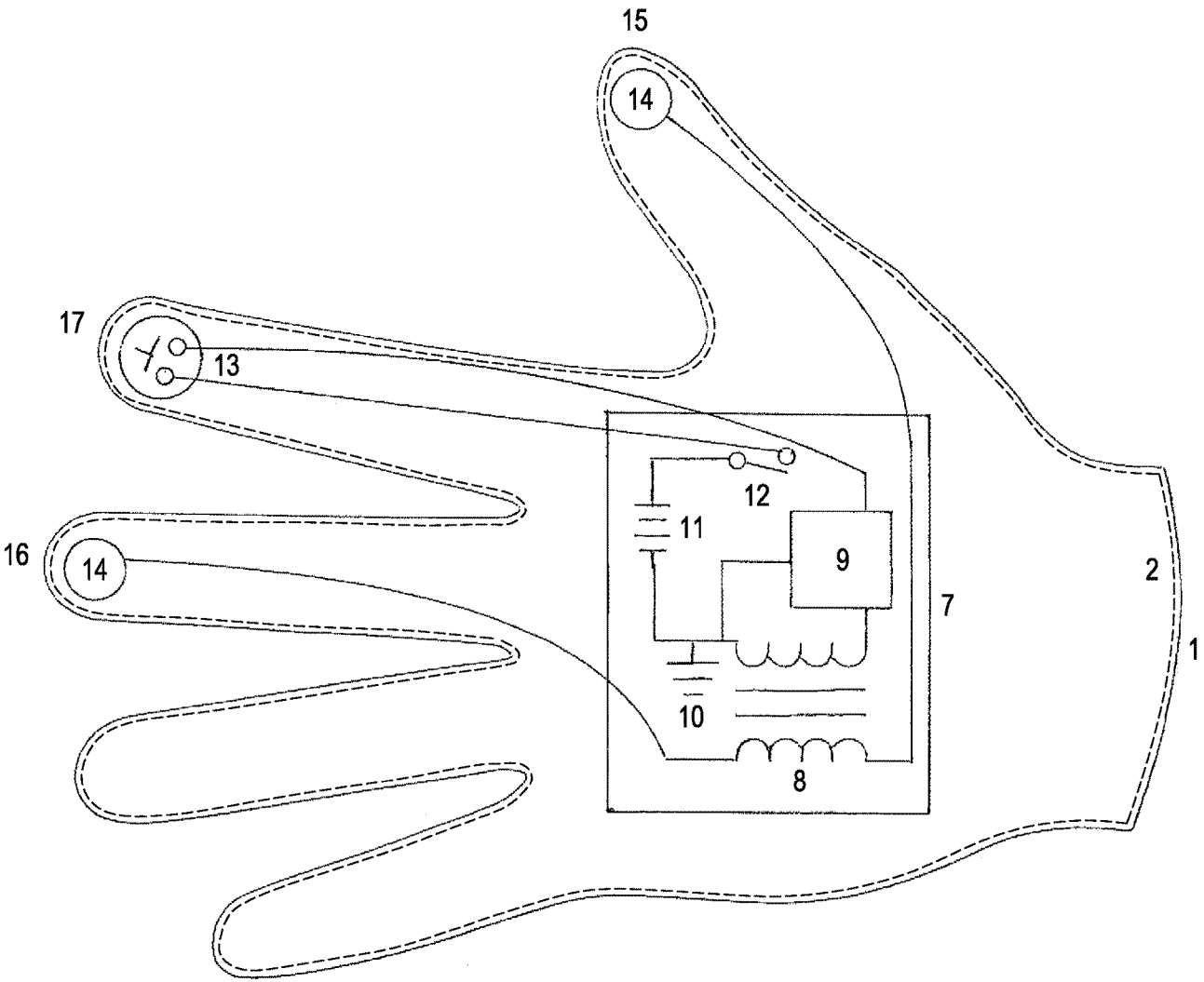

FIG. 2: Shows the components, top view of both the cloth and the invisible view of the rubber glove.

Figure 3:
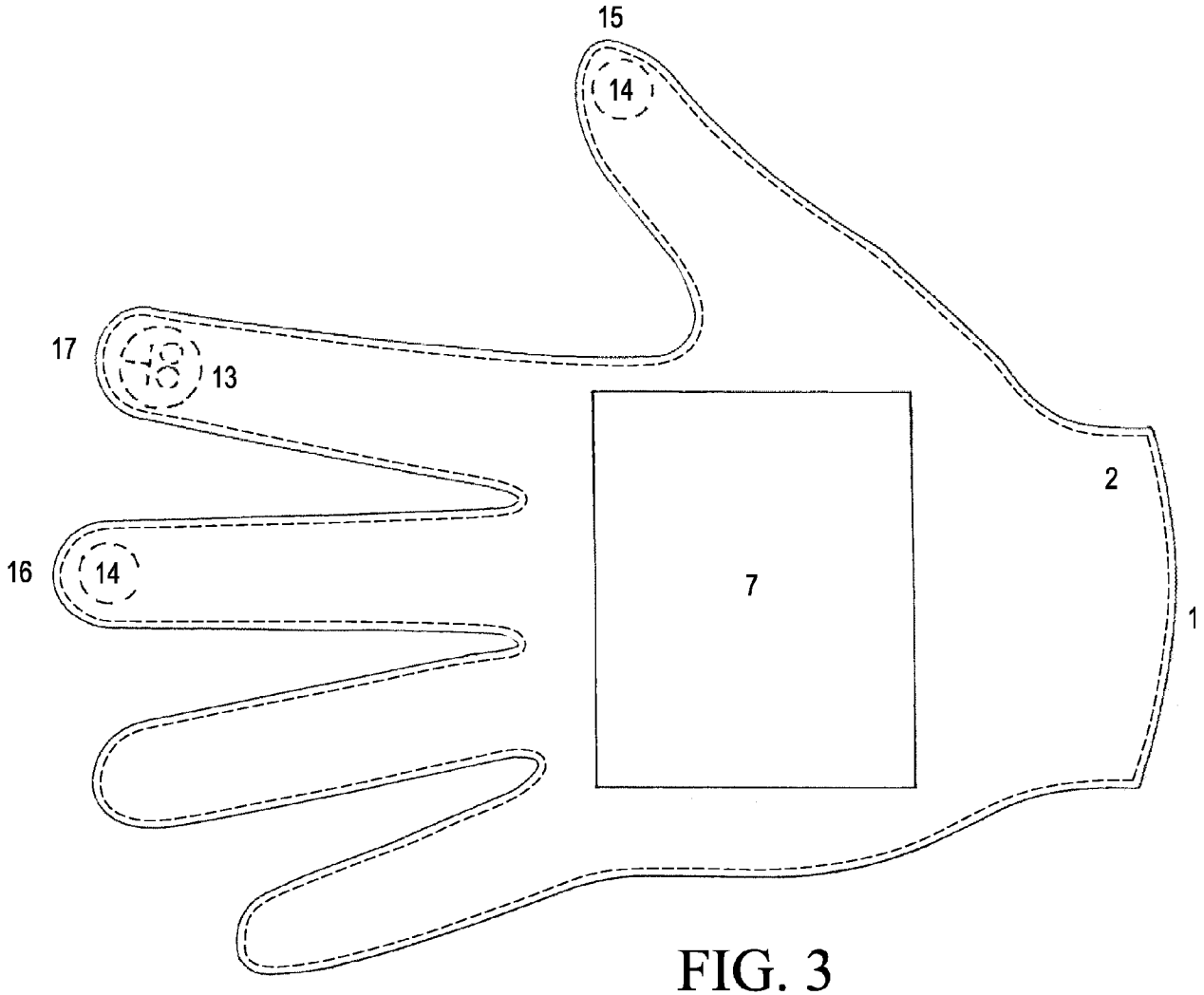

FIG. 3: Shows the top view of the cloth glove, invisible view of the rubber glove, velcro pocket, the invisible view of the secondary momentary tact switch and both invisible contact points.

Figure 4:
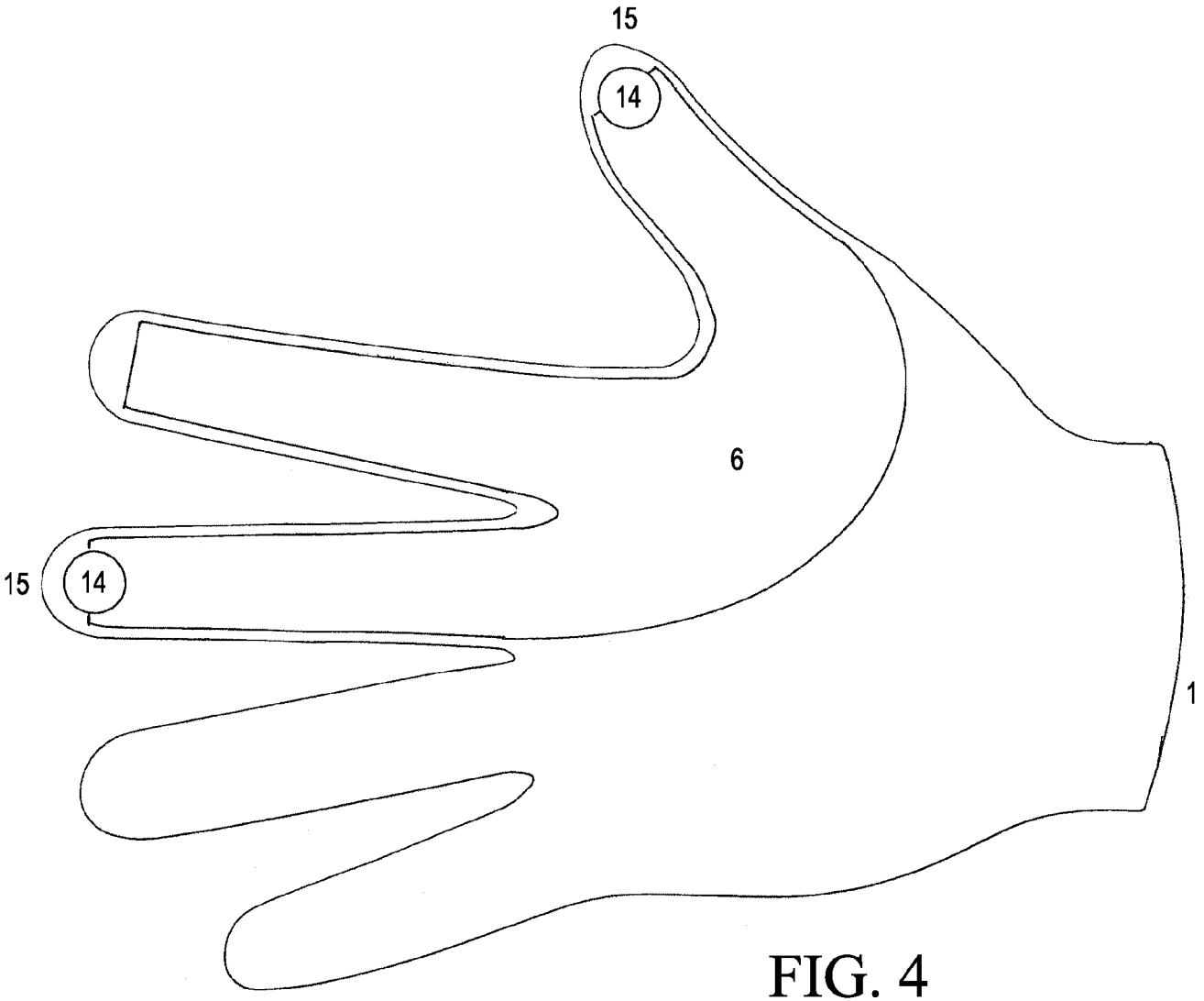

FIG. 4: Shows the bottom view of the glove, both contact tips and electrical conductive cloth.

Figure 5:
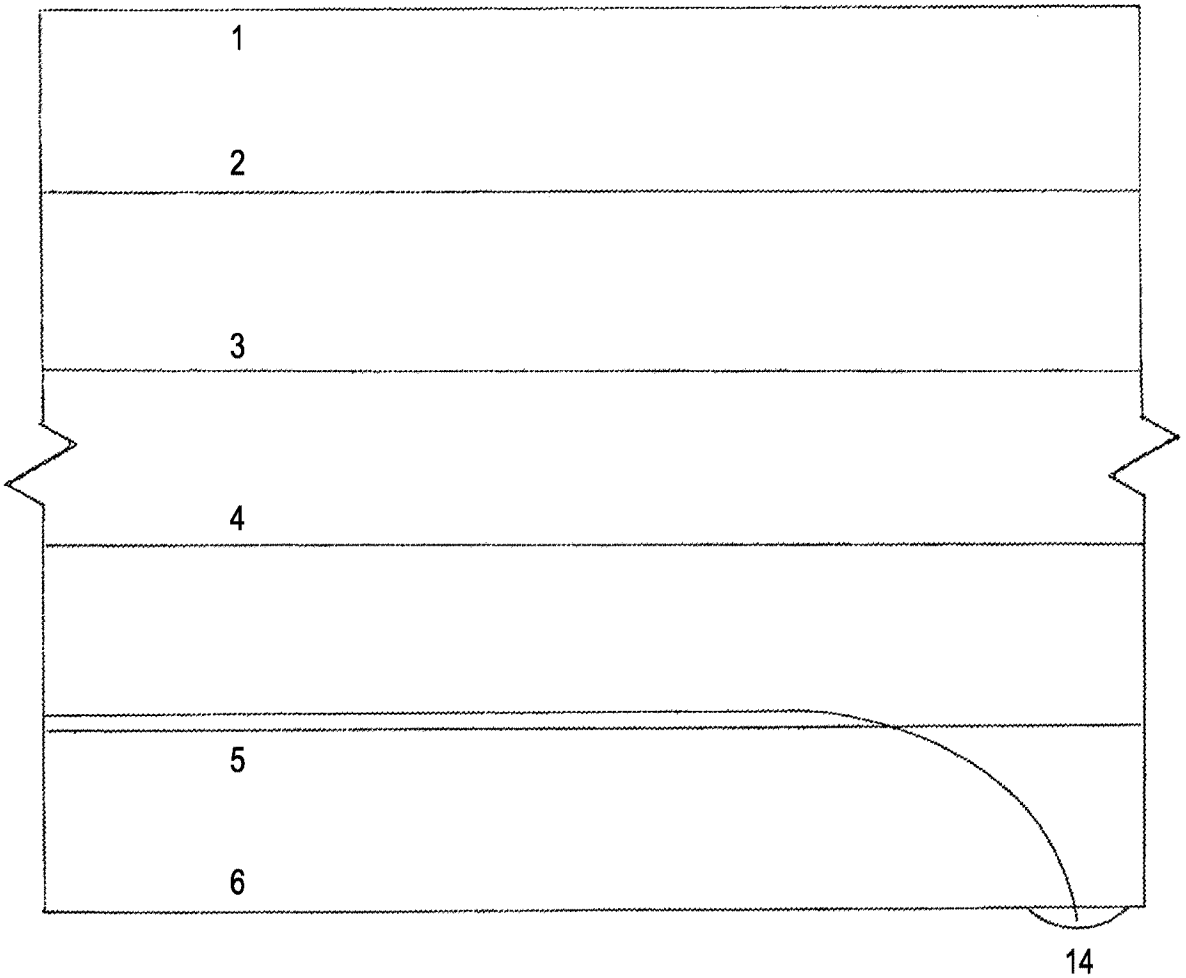

FIG. 5: Shows the enlarged cross section view of the blended set of both rubber and cloth gloves including where the hand fits.

This is a detailed description of the The T.O.U.C.H. (Temporary Offense for Ultimate Control against Harm). The invention is a self-contained, personal, protective device which I have developed.

The apparatus emits a momentary, electrical charge against an unwanted attacker for personal safety. The entire unit is housed completely inside a modified set of athletic gloves.

Please refer to FIG. 1, it shows the schematic layout of the electronics. It also details the transformer (8) the AC/DC converter (9) the ground (10) the battery (11) the primary power switch (12) the secondary momentary tact switch (13) and both contact points (14).

Please refer to FIG. 2, it shows the electrical component's, the top view of both the cloth (1) and rubber (2) gloves. First, the primary power switch (12) is connected to the secondary momentary tact switch (13) which is connected to the battery (11). From there the battery (11) is connected to the ground (10) and the transformer (8) and the AC/DC converter (9). The two contact points (14) are located on the thumb (15) and the middle index finger (16). The contact points (14) are connected directly to the transformer (8). The transformer (8) is connected to the AC/DC converter (9). The entire unit is housed inside the velcro pocket (7) on the back of each cloth glove (1).

The full power comes from three button-cell batteries (11) also hidden inside the velcro pocket (7) on the back of each cloth glove (1). There is a total of four wires and two small metal contact points (14). The contact points (14) are located on the tips of the thumb (15) and the middle index finger (16) of each cloth glove (1).

A DC/AC converter (9) in conjunction with the transformer (8) generates the controlled shock that is released through the contact points (14) on the thumb (15) and the middle index finger (16) coupled with the electrical conductive cloth (6) on each of the outer part of the cloth gloves (1).

In order to utilize the controlled shock, both metal contact points (14) must engage and make physical contact with the assailant. At that point the victim applies minimal pressure to the secondary miniature tact momentary switch (13) inside the rubber glove (2) on the first index finger (17) permitting a brief shock to be generated through the two contact points (14) and the electrical conductive cloth (6).

The sudden electrical emission is not strong enough to kill the attacker. The electrical emission is a sufficient amount of a discharge that is released through the contact points (14) on the thumb (15) and the middle index finger (16) and electrical conductive cloth (6) to stun the attacker momentarily, allowing the victim to break free and escape.

Please refer to FIG. 3, it shows the top view of the glove, the invisible view of the rubber glove (2) the invisible view of the two metal contact points (14) that releases and administers the electrical shock against the attacker. The invisible view of the secondary momentary tact switch (13) which is located on the first index finger (17).

The two metal contact points (14) are located on the thumb (15) and the middle index finger (16) of each cloth glove (1). The velcro-components pocket (7) located on the back of each cloth glove (1) is where the electronics is located.

On the tip of each glove's first index finger (17) located inside of the rubber glove (2) is a secondary miniature tact momentary switch (13). The secondary miniature tact momentary switch (13) activates the electrical charge and is released through each of the metal contact points (14). The metal contact points (14) are located on each of the thumbs (15) and the middle index fingers (16) on both cloth gloves (I).

The secondary miniature tact momentary switch (13) is hidden underneath the first index finger (17) of each of the rubber (2) and the cloth glove (1). The secondary miniature tact momentary switch (13) instantly activates the electrical defense system when the victim physically engages the unwanted attacker.

Please refer to FIG. 4, it shows the special electrical conductive cloth (6). Its purpose is to increase the shock area of the glove in conjunction with the contact points (14) on the thumb (15) and the middle index finger (16) of each cloth glove (1).

Please refer to FIG. 5, it shows an enlarged cross section of the blend of both the cloth (1) and the rubber glove (2). The rubber part of the blend, where the hand is seated (3), prevents the victim
from shocking themselves while storing the electronics in a hidden velcro pocket (7) on the back of each cloth glove (1). The electrical components, inside of the velcro pocket (7) generate the charge used to deter the attacker.

In addition, FIG. 5, details the cross section of both the cloth (1) and the rubber (2) gloves' unit. The drawing, depicts where the hand (3) is inserted and firmly seated. The top of the glove is the first cloth layer (1). Immediately below is the second layer glove which is rubber (2). The middle part of the drawing is where the hand fits (3).

Inverting the process, the next layer under the palm of the hand is the bottom side of the second glove which is rubber (4). In between the cloth (1) and rubber gloves' section (2) is one of two wires running along the thumb (15) and middle index fingers (16) which is connected to a metal contact point (14) on the thumb (15) and the middle index finger (16).

The last part is the bottom of the cloth glove (5). Attached to the cloth glove is a separate piece of electrical conductive cloth (6) which increases the shock area. Attached to the conductive cloth (6) is one of the two metal-conductive tips (14). There is a metal contact tip (14) on the end of each of the thumb (15) and each middle index finger (16) of the outer portion of the cloth glove (1).

What is claimed is:

1. A protective device for emitting an electrical charge against an unwanted attacker, the protective device comprising:

(a) an electrical system for emitting an electrical charge against an unwanted attacker, said electrical system including a power source for generating an electrical charge, said electrical system further including at least one activation member for activating said electrical system to emit an electrical charge against an unwanted attacker;

(b) at least one glove to be worn on a hand of a user, said at least one glove being configured to prevent the electrical charge from being transmitted to the user wearing the at least one glove, said at least one glove being connected to said electrical system; and, (c) said at least one glove having an electrically conductive layer having a first shock area for transmitting the electrical charge against an unwanted attacker, said first shock area forming a single shock area covering at least a portion of the user's thumb and at least a portion of at least one of the user's fingers, said electrically conductive layer being connected to said power source.

2. The protective device of claim 1, wherein:

(a) said at least one activation member includes a power switch and a momentary switch, said electrical system being configured such that the electrical charge is generated only upon activation of said power switch and said momentary switch.

3. The protective device of claim 2, wherein:

(a) said momentary switch is disposed on an index finger portion of said at least one glove and said power switch is disposed in a hidden pocket of said at least one glove.

4. The protective device of claim 3, wherein:

(a) said electrical system includes a first metallic contact disposed on a middle finger portion of said at least one glove.

5. The protective device of claim 4, wherein:

(a) said electrical system includes a second metallic contact disposed on a thumb portion of said at least one glove.

6. The protective device of claim 5, wherein:

(a) said first metallic contact member and said second metallic contact member connect said electrically conductive layer to said power source.

7. A protective device for emitting an electrical charge against an unwanted human attacker, the protective device comprising:

(a) a self-contained protective device configured to be worn on a single hand of a user;

(b) said self-contained protective device including an electrical system for emitting an electrical charge against an unwanted human attacker, said electrical system including a power source for generating an electrical charge, said electrical system further including at least one activation member for activating said electrical system to emit an electrical charge against an unwanted human attacker;

(c) said self-contained protective device further including at least one glove to be worn on the hand of the user, said at least one glove being configured to prevent the electrical charge from being transmitted to the user wearing the at least one glove, said at least one glove being connected to said electrical system; and, (d) said at least one glove having an electrically conductive layer having a first shock area for transmitting the electrical charge against an unwanted human attacker, said first shock area forming a single shock area covering at least a portion of the user's thumb and at least a portion of at least one of the user's fingers, and said electrically conductive layer being connected to said power source.

8. The protective device of claim 7, wherein:

(a) said at least one activation member includes a power switch and a momentary switch, said electrical system being configured such that the electrical charge is generated only upon activation of said power switch and said momentary switch.

9. The protective device of claim 8, wherein:

(a) said momentary switch is disposed on an index finger portion of said at least one glove and said power switch is disposed in a hidden pocket of said at least one glove.

10. The protective device of claim 9, wherein:

(a) said electrical system includes a first metallic contact disposed on a middle finger portion of said at least one glove.

11. The protective device of claim 10, wherein:

(a) said electrical system includes a second metallic contact disposed on a thumb portion of said at least one glove.

12. The protective device of claim 11, wherein:

(a) said first metallic contact member and said second metallic contact member connect said electrically conductive layer to said power source to cause an electric charge to run through said electrically conductive layer, said first metallic contact member connects said electrically conductive layer to a first charged terminal of said power source and said second metallic contact member connects said electrically conductive layer to a second charged terminal of said power source wherein said first charged terminal having an opposite charge from said second charged terminal.

13. A protective device for emitting an electrical charge against an unwanted human attacker, the protective device comprising:

(a) an electrical system for emitting an electrical charge against an unwanted human attacker, said electrical system including a power source for generating an electrical charge, said electrical system further including at least one activation member for activating said electrical system to emit an electrical charge against an unwanted human attacker;

(b) at least one glove to be worn on a hand of a user, said at least one glove being configured to prevent the electrical charge from being transmitted to the user wearing the at least one glove, said at least one glove being connected to said electrical system;

(c) said at least one glove having an electrically conductive layer having a first shock area for transmitting the electrical charge against an unwanted human attacker, said first shock area forming a single shock area covering at least a portion of the user's thumb and at least a portion of at least one of the user's fingers, said electrically conductive layer being connected to said power source; and, (d) said electrically conductive layer having first and second portions, said first portion of said electrically conductive layer being connected to a positive terminal of said power source and said second portion of said electrically conductive layer being connected to a negative terminal of said power source to cause an electric charge to run through said electrically conductive layer.

14. The protective device of claim 13, wherein:

(a) said at least one activation member includes a power switch and a momentary switch, said electrical system being configured such that the electrical charge is generated only upon activation of said power switch and said momentary switch.

15. The protective device of claim 14, wherein:

(a) said momentary switch is disposed on an index finger portion of said at least one glove and said power switch is disposed in a hidden pocket of said at least one glove.

16. The protective device of claim 13, wherein:

(a) said electrical system includes a first metallic contact disposed on a middle finger portion of said at least one glove to connect said first portion of said electrically conductive layer to said negative terminal of said power source.

17. The protective device of claim 16, wherein:

(a) said electrical system includes a second metallic contact disposed on a thumb portion of said at least one glove to connect said second portion of said electrically conductive layer to said positive terminal of said power source.

* * * * *